United States Patent [19]

Schneiter

[11] 4,090,354

[45] May 23, 1978

[54] COUNTING MECHANISM FOR TIMEPIECE

[75] Inventor: Ali Schneiter, Neuchatel, Switzerland

[73] Assignee: Ebauches S.A., Neuchatel, Switzerland

[21] Appl. No.: 683,646

[22] Filed: May 6, 1976

[30] Foreign Application Priority Data

Mar. 24, 1976 Switzerland ..... 006178/76

[51] Int. Cl.[2] ..... G04B 15/00

[52] U.S. Cl. ..... 58/117; 58/116 R; 74/1.5

[58] Field of Search ..... 58/116 R, 116 M, 117–120, 58/107–109, 59, 7, 23 R; 74/1.5

[56] References Cited

U.S. PATENT DOCUMENTS

| | | | |
|---|---|---|---|
| 2,970,427 | 2/1961 | Douglass | 58/117 |
| 3,577,875 | 5/1971 | Stcherbatcheff | 58/116 R |
| 3,670,493 | 6/1972 | Wuthrich | 58/116 M |
| 3,949,547 | 4/1976 | Schneiter | 58/116 R |

*Primary Examiner*—Ulysses Weldon

*Attorney, Agent, or Firm*—St. Onge, Mayers, Steward & Reens

[57] ABSTRACT

A counting mechanism for a timepiece in which the drive means therefor oscillates a counting wheel, which in turn drives a co-axially mounted ratchet wheel in one direction. The counting wheel and ratchet wheel are interconnected so that during each oscillation of the counting wheel, both wheels first move in unison in one direction and then the counting wheel alone is driven in the other direction against a resilient coupling member while the ratchet wheel is held stationary by a pawl. The counting wheel is released between each cycle of oscillations, so that it can be returned by the resilient coupling member to its normal position with respect to the ratchet wheel.

8 Claims, 9 Drawing Figures

COUNTING MECHANISM FOR TIMEPIECE

The present invention relates to a counting mechanism for a timepiece having drive means with alternate movement, in which the rotor cooperates with a counting wheel so as to drive the counting mechanism only in one direction.

This counting mechanism is characterized by the fact that it comprises a ratchet wheel, coaxial to the said counting wheel, and which is submitted to the action of a retaining pawl preventing if from rotating in the counter direction, that is to say in the direction contrary to its normal running direction. The drive means, which may for example be a balance wheel, oscillates the counting wheel in one direction and then in the other, releasing it between each complete oscillating cycle. Means are provided for coupling the counting wheel to the ratchet wheel in a predetermined angular relationship to each other such that both wheels are driven in unison in one direction, such coupling means including a resilient coupler that allows the counting wheel to be driven in the other direction while the ratchet wheel is held in a fixed position by the pawl. When the counting wheel is released by the drive means, it is returned by the resilient coupler to its initial position relative to the ratchet wheel so that on the next stroke of the drive means both wheels are rotated again in the normal direction of rotation.

The drawing shows, by way of example, three embodiments of the object of the invention and a modification.

The counting mechanism disclosed and represented, also called click mechanism, serves to transmit to the time indicators — hands or discs — the movement produced by the motor having an alternate or oscillating movement, which, in the example represented is a balance wheel 1 rigid with a plate 2 carrying a drive pin 3.

Figure 1:
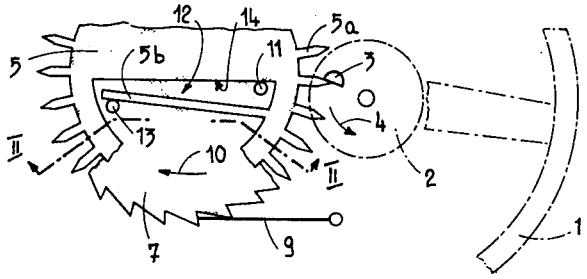
FIG. 1 is a plan view, with parts taken away, of a first embodiment of a counting mechanism for an electric watch having a motor balance wheel.

Such a mechanism must ensure that, during the oscillations of the balance wheel in one direction, i.e. in the direction of the arrow 4 of FIG. 1, the movement is transmitted to the time indicators while, during the movements of the balance wheel in the other direction, the gearing driving the time indicators be not driven.

In the example represented, the pin 3 carried by the plate 2 of the balance wheel cooperates with the teeth 5*a* of a counting wheel 5 loosely mounted on the shaft 6 of a ratchet wheel 7. This ratchet wheel is rigid with a pinion 8 (FIG. 2) which constitutes the first element of the gearing for the time indicators. The ratchet wheel 7 is subjected to the action of a retaining pawl 9 allowing it to rotate only in the direction of the arrow 10 of FIG. 1 and not in the counter direction. The ratchet wheel 7 carries a pin 11 passing through an aperture 12 provided in the counting wheel 5. This ratchet wheel carries a second pin, designated by 13, intended to cooperate, as it will be hereafter indicated, with an elastic arm 5*b* of the wheel 5, extending transversally in the aperture 12 of this wheel.

When the wheel 5 is driven clockwise as viewed in FIG. 1, by the pin 3 of the balance wheel as it moves counterclockwise in the direction of the arrow 4, the edge 14 of its aperture 12 bears against the pin 11 so that the ratchet wheel 7 is driven in the direction of the arrow 10 in unison with wheel 5.

When the balance wheel is displaced in the opposite or clockwise direction, that is to say in the direction opposite to the arrow 4, the wheel 5 is driven in the counterclockwise direction by the pin 3, but the wheel 7 is prevented from following this movement by the pawl 9. During this counter displacement of the wheel 5, the elastic arm 5*b* of this wheel bears against the pin 13 of the wheel 7 and is deformed elastically until the pin 3 of the balance wheel leaves the tooth 5*a* of the wheel 5 on which it was acting, thereby releasing the counting wheel that it can be returned into its initial position by the elastic arm 5*b*, which constitutes a return spring. Consequently, during the movement of the counting wheel 5 in the counter clockwise direction, the elastic arm 5*b* is subjected only to a slight oscillating movement of reciprocation.

Figure 2:
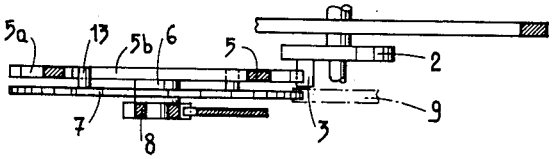
FIG. 2 is a sectional view along line II—II of FIG. 1.
Figure 3:
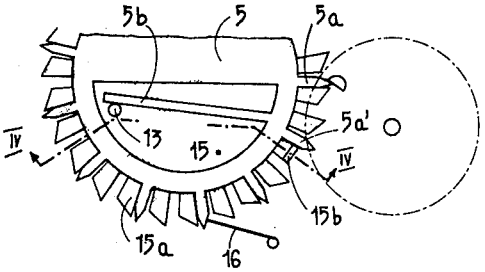
FIG. 3 is a plan view of a modification of a counting mechanism for electric watch having a motor balance wheel.
Figure 4:
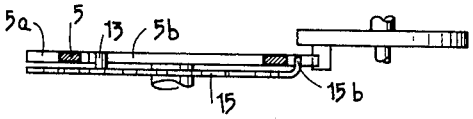
FIG. 4 is a sectional view along line IV—IV of FIG. 3.

The modification of FIGS. 3 and 4 distinguishes from the first embodiment mainly by the fact that the ratchet wheel, designated by 15, with which a pawl 16 cooperates, carries only one pin, i.e. pin 13 cooperating with the elastic arm 5*b* of the counting wheel 5, the pin 11 of the embodiment of FIGS. 1 and 2 having been eliminated. In lieu of this pin 11, the number of the teeth, designated by 15*a*, of the ratchet wheel 15, is the double the number of the teeth, designated by 5*a*, of the counting wheel 5. One of the teeth 15*a* of the ratchet wheel has its end bent at 15*b* and serves as an abutting member for one of the teeth 5*a*, designated by 5*a'*, of the wheel 5. The bent tooth 15*b* acts as the pin 11 of the first embodiment.

In this modification, it is not necessary to precisely position a pin on the ratchet wheel, as it is the case for the pin 11, since the abutment member is constituted by a bent tooth of the wheel 15, made of one piece with this wheel. Hence the position of the bent tooth 15*b* is exact without it being necessary to take special steps therefore.

The advantage of the present arrangement lies in the fact that the torque of positioning produced by the retaining pawl (9 in the first embodiment and 16 in the modification) is independent of the back torque, which is here given by the spring constituted by the elastic arm 5*b*. It is thus possible to reduce the strength of the return spring to a minimum without diminishing the positioning torque and, consequently, the reliability of operating of the mechanism. Hence the torque which must be furnished by the balance wheel, is determined only by the back torque opposed by the gearing for the time indicators, which back torque must be surmounted for ensuring the driving of these indicators. In contrast, in conventional mechanisms the torque required provide reliable operation must be sufficient to ensure that the balance wheel can not only drive the time indicators, but also overcome the resistance of the counting wheel during the driving pulse. Such arrangements have therefore resulted in loss of energy.

Figure 5:
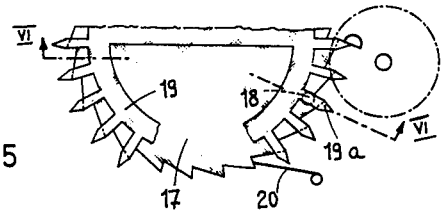
FIG. 5 is a plan view, with a portion taken away, of a second embodiment of a counting mechanism for an electric watch having a motor balance wheel.
Figure 6:
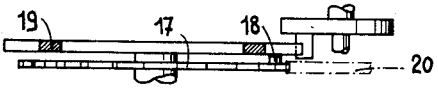
FIG. 6 is a sectional view along line VI—VI of FIG. 5.

The same advantages appear in the embodiment of FIGS. 5 and 6 in which the ratchet wheel, designated by 17, carries a permanent magnet 18 cooperating with a tooth 19*a* of the counting wheel, designated by 19. When the counting wheel is driven in its normal direction, the ratchet wheel 17 is also driven, owing to the magnetic connection due to the magnet 18, without producing any relative displacement between these two wheels. When, on the contrary, the counting wheel 19 is driven in the counter direction, the ratchet wheel 17, retained by a pawl 20, does not follow it, thus producing relative displacement between these two wheels. The return force exerted by the magnet 18 then brings the counting wheel 19 back as soon as it is released from the action of the rotor into its initial position, i.e. into the relative position it occupies normally with respect to the ratchet wheel 17.

As a modification, the ratchet wheel 17 could carry an abutting pin corresponding to the pin 11 of the first embodiment, which would cooperate with the counting wheel 19, so as to permit the use of a weaker magnet 18. As a matter of fact, the magnet would then only have to ensure the return of the counting wheel 19 and would not drive the ratchet wheel 17.

Figure 7:
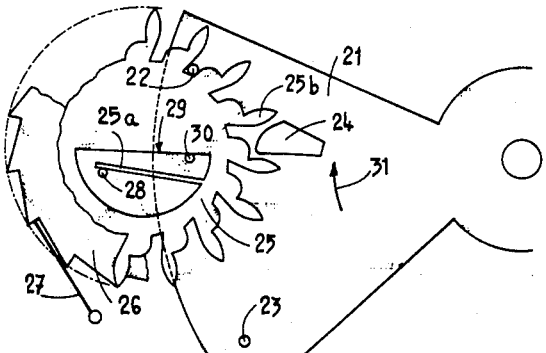
FIGS. 7, 8 and 9 are plan views of a third embodiment of a counting mechanism represented in three different operating positions.
Figure 8:
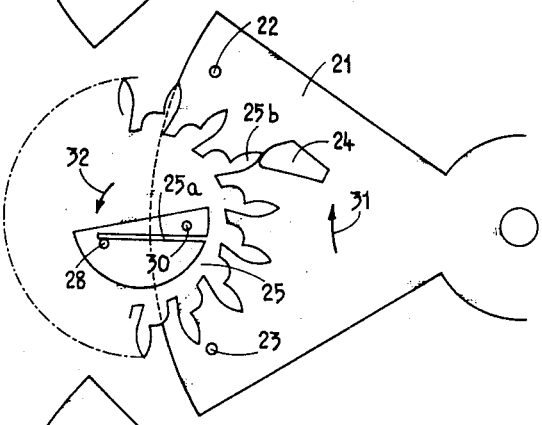
Figure 9:
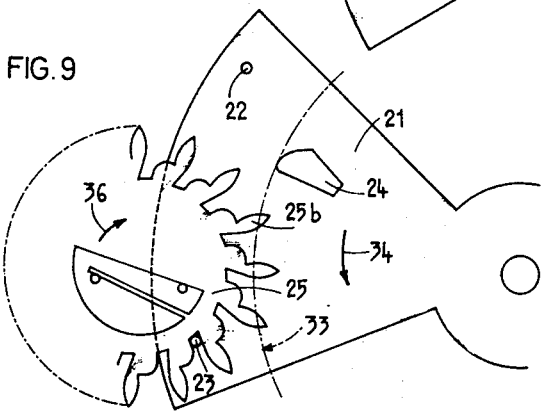

In the embodiment of FIGS. 7 to 9, the plate of the balance wheel acts on an anchor, designated by 21, partially visible in the drawing, which is provided with three protrusions, i.e. two pins 22 and 23 and a lock 24, all of which cooperate with a counting wheel 25. This counting wheel 25 is connected to a ratchet wheel 26 (FIG. 7), which is subjected to the action of a retaining pawl 27 by an elastic arm 25*a* cooperating with a pin 28 carried by the ratchet wheel 26. Wheel 25 is also subjected to the action of its edge 29 of an aperture provided therein against a pin 30 carried by the ratchet wheel 26. The connection between the counting wheel 25 and the ratchet wheel 26 is thus identical with the connection of the first embodiment.

The mechanism of FIGS. 7 to 9 operates as follows:

When the anchor 21 occupies one of its extreme positions after having rotated in the counter clockwise direction, represented in FIG. 7, its pin 22 cooperates with the teeth of the wheel 25, locking said wheel in place. The anchor 21 is then moved in the direction of the arrow 31 of FIGS. 7 and 8, during which movement the lock 24, acting on one tooth 25*b* of the counting wheel 25, drives this wheel in the direction of the arrow 32, counter to the normal running direction of the counting mechanism. Since the ratchet wheel 26 is retained by the pawl 27 so that the pin 28 is stationary, the elastic arm 25*a* of the counting wheel 25 is flexed during such counter stroke. Hence, at the moment when the lock 24 of the anchor leaves the tooth 25*b*, the wheel 25 is immediately driven in the direction designated by the arrow 36 in FIG. 9 by the elastic effect of the arm 25*a* through an arc sufficient for the tooth 25*b* to come within the arcuate path 33 (FIG. 9) of the end of the lock 24 of the anchor 21. The stability of the wheel 25 is thus ensured by the pin 23 engaging between two teeth of this wheel. During the next stroke of the anchor 21, in the direction of the arrow 34 (FIG. 9), the lock 24 acts on the tooth 25*b* for moving the wheel 25 again in the direction of the arrow 36. Thus, during its two alternate movements, the balance wheel will drive the wheel 25 and, consequently, the ratchet wheel 26, in the clockwise direction through an arc equal to the pitch of the teeth on the counting wheel.

What I claim is:

1. A counting mechanism for a timepiece comprising
a counting wheel pivotally mounted for oscillation,
drive means for oscillating said counting wheel in one direction and then in the other, said drive means being adapted and arranged to release said counting wheel between each oscillating cycle,
a ratchet wheel rotatably mounted co-axially of said counting wheel for step-by-step rotation in said one direction,
a retaining pawl for preventing rotation of said ratchet wheel in said other direction, and
coupling means including a resilient coupler for interconnecting said counting wheel and said ratchet wheel in a predetermined angular relationship to each other such that during each such oscillating cycle said drive means drives said counting and ratchet wheels in unison in said one direction and then drives said counting wheel in said other direction against said resilient coupler out of said predetermined angular relationship with said ratchet wheel, said counting wheel being returned to such relationship with said ratchet wheel by said resilient coupler upon release of said counting wheel by said drive means.

2. A counting mechanism as defined in claim 1, wherein said coupling means further includes a member mounted on one of said wheels by which said ratchet wheel is positively driven by said counting wheel in said one direction.

3. A counting mechanism as defined in claim 2, wherein said member comprises a pin mounted on said ratchet wheel said counting wheel having an aperture through which said pin extends such that one wall of said aperture bears against said pin when said counting wheel is driven in said one direction thereby driving said ratchet wheel in said one direction.

4. A counting mechanism as defined in claim 1, wherein said resilient coupler comprises a pin mounted on said ratchet wheel and an elastic arm on said counting wheel, the free end of which bears against said pin when said ratchet wheel is driven in said other direction, whereby said arm is elastically deformed in order to permit said counting wheel to pivot in said other direction out of said angular relationship with said ratchet wheel while said ratchet wheel is held stationary by said pawl, said arm returning said counting wheel to its initial position upon release of said counting wheel by said drive means.

5. A counting mechanism as defined in claim 2, wherein the number of teeth on said ratchet wheel is double the number of teeth on said counting wheel, at least one of said teeth of said ratchet wheel being bent so as to be disposed between two teeth of said counting wheel for engagement therewith and forming said coupling member, said one tooth of said ratchet wheel bearing against one of said teeth of said counting wheel when said counting wheel is driven in said one direction thereby driving said ratchet wheel in said one direction.

6. A counting mechanism as defined in claim 1, wherein said coupling means comprises a permanent magnet mounted on one of said wheels for resiliently driving the other and for magnetically returning said counting wheel into said predetermined angular relationship with said ratchet wheel.

7. A counting mechanism as defined in claim 1, wherein said drive means comprises a balance wheel having a plate rigid therewith which carries a drive pin disposed for direct engagement with said counting wheel.

8. A counting mechanism as defined in claim 1, wherein said drive means comprises an anchor pivotally mounted for oscillation between two extremes, said anchor having two pins mounted thereon each of which is disposed for engagement with the teeth of said counting wheel upon movement of said anchor to one of said extremes for ensuring the stability of each position of said counting wheel, and a protrusion on said anchor disposed for engagement with said counting wheel for driving said counting wheel step-by-step upon oscillation of said anchor.

* * * * *

UNITED STATES PATENT OFFICE

CERTIFICATE OF CORRECTION

Patent No. 4,090,354 Dated May 23, 1978

Inventor(s) Ali Schneiter

It is certified that error appears in the above-identified patent and that said Letters Patent are hereby corrected as shown below:

On the title page, under "[30] Foreign Application Priority Data", change "Mar. 24, 1976" to -- May 14, 1975 --.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*